US009122184B2

(12) United States Patent
Mikajiri

(10) Patent No.: US 9,122,184 B2
(45) Date of Patent: Sep. 1, 2015

(54) IMAGE FORMING APPARATUS INCLUDING A DOWNSIZED IMAGE CARRIER OF AN ADDITIONAL COLOR THEREIN

(71) Applicant: Susumu Mikajiri, Tokyo (JP)

(72) Inventor: Susumu Mikajiri, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/189,116

(22) Filed: Feb. 25, 2014

(65) Prior Publication Data

US 2014/0267538 A1 Sep. 18, 2014

(30) Foreign Application Priority Data

Mar. 13, 2013 (JP) ..... 2013-050444
Sep. 4, 2013 (JP) ..... 2013-182943

(51) Int. Cl.

*B41J 15/14* (2006.01)
*B41J 27/00* (2006.01)
*G03G 15/01* (2006.01)
*G03G 15/04* (2006.01)

(52) U.S. Cl.

CPC ..... *G03G 15/011* (2013.01); *G03G 15/0409* (2013.01); *G03G 15/04072* (2013.01); *G03G 2215/0132* (2013.01)

(58) Field of Classification Search

USPC ..... 347/225, 230, 232, 233, 238, 241–243, 347/256–261, 263

See application file for complete search history.

(56) References Cited

U.S. PATENT DOCUMENTS

| | | | | |
|---|---|---|---|---|
| 6,788,321 | B2 * | 9/2004 | Araki et al. | 347/138 |
| 7,760,228 | B2 * | 7/2010 | Mamiya | 347/257 |
| 2003/0099492 | A1 * | 5/2003 | Maeyama et al. | 399/302 |
| 2007/0248386 | A1 * | 10/2007 | Uduki | 399/299 |
| 2009/0314927 | A1 * | 12/2009 | Tatsuno et al. | 250/205 |

FOREIGN PATENT DOCUMENTS

| | | | | |
|---|---|---|---|---|
| JP | 2002258197 | A * | 9/2002 | G02B 26/10 |
| JP | 2007-171498 | | 7/2007 | |
| JP | 2007-316313 | | 12/2007 | |
| JP | 2011-253132 | | 12/2011 | |
| JP | 2011253132 | A * | 12/2011 | G03G 15/01 |
| JP | 2012-003105 | | 1/2012 | |

* cited by examiner

*Primary Examiner* — Hai C Pham

(74) *Attorney, Agent, or Firm* — Harness, Dickey & Pierce, P.L.C.

(57) ABSTRACT

An image forming apparatus includes image carriers for four fundamental colors of black, cyan, magenta, and yellow, and for an auxiliary color, and three optical scanning devices. A first optical scanning device includes two light sources for the black color and another fundamental color, a first deflector, and a first housing. A second optical scanning device includes two light sources for other two fundamental colors, a second deflector, and a second housing. A third optical scanning device includes a light source for the auxiliary color, a third deflector, a third housing, and one or more reflecting mirrors. The light source for the auxiliary color is disposed closer to the third deflector with the one or more reflecting mirrors to turn an optical path therebetween while maintaining an optical path length thereof. The optical paths for the auxiliary color and for the black color have identical light utilization efficiency.

3 Claims, 14 Drawing Sheets

IMAGE FORMING APPARATUS INCLUDING A DOWNSIZED IMAGE CARRIER OF AN ADDITIONAL COLOR THEREIN

CROSS-REFERENCE TO RELATED APPLICATIONS

This patent application is based on and claims priority pursuant to 35 U.S.C. §119 to Japanese Patent Application Nos. 2013-050444, filed on Mar. 13, 2013, and 2013-182943, filed on Sep. 4, 2013, in the Japan Patent Office, the entire disclosure of each of which is hereby incorporated by reference herein.

BACKGROUND

1. Technical Field

Embodiments of this disclosure generally relate to an image forming apparatus, and more particularly, to an image forming apparatus for forming a multicolor image.

2. Related Art

Demand for higher-quality images is increasing in association with recent improvements in image forming apparatuses. One approach to obtaining higher-quality images involves providing electrophotographic image forming apparatuses incorporating toner of five or more colors including the usual four colors, namely, yellow (Y), magenta (M), cyan (C), and black (K). For example, JP-2007-171498-A and JP-2007-316313-A propose an image forming apparatus incorporating toner of six colors.

Such an image forming apparatus incorporating toner of five or more colors typically incorporates toner of a light color (e.g., light cyan or light yellow) and/or high-transparent toner (e.g., transparent toner) in addition to toner of the four fundamental colors, namely, yellow, magenta, cyan, and black. Such an additional color is called "auxiliary color" and is used to obtain an image with higher quality, glossiness, and color reproducibility.

The light-color toner is used to reduce the granularity of an output image, thereby enhancing image quality. The high-transparent toner is used to enhance glossiness. In some cases, a color that is difficult to reproduce by mixing yellow, magenta, and cyan may be used as an auxiliary color, or may be formed as a special color to be used in, e.g., a printer.

Image forming apparatuses typically employ a tandem method with an intermediate transfer belt to form color images. In such tandem-type image forming apparatuses, image carriers for different colors of toner are arrayed in series, each being associated with, e.g., a developing device loaded with developer having individual spectral characteristics. The tandem-type image forming apparatuses can form a color image at almost the same speed as the monochrome image forming apparatuses.

Such a tandem-type image forming apparatus includes optical systems having identical configurations based on the optical system for black. Hence, if a typical tandem-type image forming apparatus uses toner of five colors, instead of four colors, it needs 25% more space to incorporate an imaging unit and an optical scanning device for an additional color.

To minimize the additional space, components of imaging units, such as photoconductive drums, developing devices, and cleaners, may be downsized or shapes thereof may be changed to locate the imaging units closer to each other. However, downsizing the optical scanning devices is not easy while keeping a predetermined optical path length.

Hence, to downsize an optical scanning device for an auxiliary color without changing the optical path length, reflecting mirrors may be provided in the optical system between a polygon mirror serving as a deflector and a photoconductive drum to increase the number of turns in the optical path. However, such a configuration decreases light utilization efficiency of the optical system between a light source and the polygon mirror depending on the reflectance of the mirrors. In addition, the arrangement of the mirrors may change the arrangement of other optical elements and a layout of light beams. Consequently, initial characteristics and temperature characteristics of a scanning line of the auxiliary color may differ from those of the four fundamental colors over time, and particularly by variation of characteristics due to temperature changes. As a result, the auxiliary color may be noticeably misaligned or shifted from the correct position.

In such a situation, with a temperature difference among a plurality of optical scanning devices, the image forming apparatuses frequently perform a color shift correction to form a high-quality image. The color shift correction and the imaging operation are not performed simultaneously, and accordingly, productivity decreases when the color shift correction is performed frequently. As a result, a standby time lengthens, significantly degrading usability.

SUMMARY

This specification describes below an improved image forming apparatus. In one embodiment of this disclosure, the image forming apparatus for forming a multicolor image with toner of four fundamental colors of yellow, magenta, cyan, and black, and toner of at least one auxiliary color different from the four fundamental colors includes a main body frame, a plurality of image carriers for the four fundamental colors, an image carrier for the at least one auxiliary color, a first optical scanning device for the black color and another color of the four fundamental colors, to irradiate each of the plurality of image carriers for the black color and the another color of the four fundamental colors to form a latent image thereon, a second optical scanning device for other two of the four fundamental colors, to irradiate each of the plurality of image carriers for the other two of the four fundamental colors to form a latent image thereon, and a third optical scanning device for the at least one auxiliary color, to irradiate the image carrier for the at least one auxiliary color to form a latent image thereon. The first optical scanning device includes two light sources for the black color and the another color of the four fundamental colors, respectively, to output luminous flux, a first deflector to deflect the luminous flux in an optically symmetrical manner, and a first optical housing removably mounted on the main body frame. The first deflector is rotatably mounted on the first optical housing. The second optical scanning device includes two light sources for the other two of the four fundamental colors, respectively, to output luminous flux, a second deflector to deflect the luminous flux in an optically symmetrical manner, and a second optical housing removably mounted on the main body frame. The second deflector is rotatably mounted on the second optical housing. The third optical scanning device includes a light source for the at least one auxiliary color to output luminous flux, a third deflector to deflect the luminous flux, and a third optical housing removably mounted on the main body frame. The third deflector is rotatably mounted on the third optical housing. The third optical scanning device further includes one or more reflecting mirrors disposed on an optical path from the light source for the at least one auxiliary color to the third deflector, with a distance between the light source for the at least one auxiliary color and the third deflector shorter than a distance between each of the light sources for the four fundamental colors and the first deflector and the second deflector, to turn the optical path from the light source for the at least one auxiliary color to the third deflector while maintaining an optical path length thereof equal to each of optical path lengths from the light sources for the four fundamental colors to the first deflector and the second deflector. The optical path from the light source for the at least one auxiliary color to the third deflector has a light utilization efficiency equal to a light utilization efficiency of the optical path from the light source for the black color to the first deflector.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
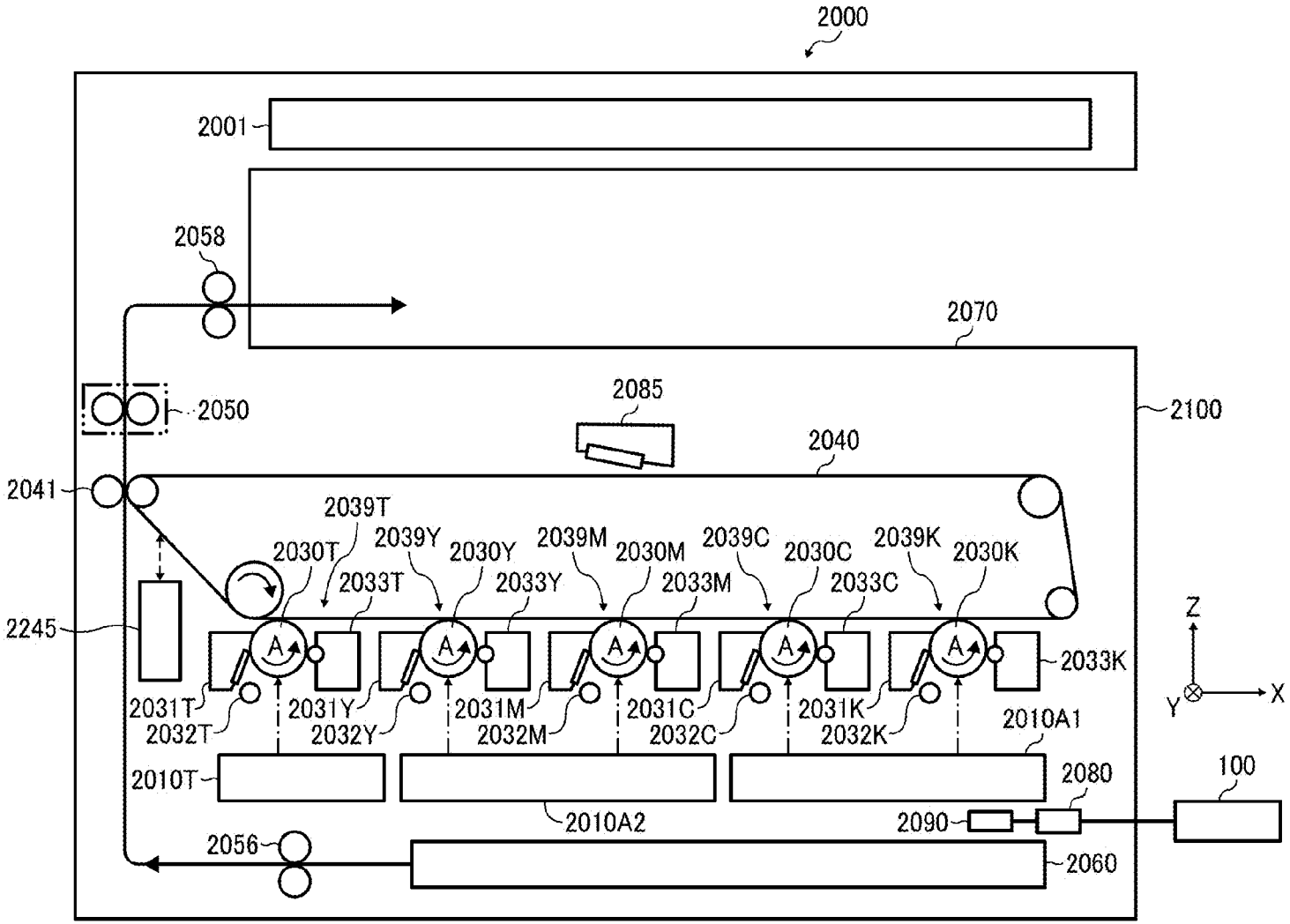
FIG. 1 is a schematic overall view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Initially with reference to FIG. 1, a description is given of a configuration of an image forming apparatus 2000 according to an embodiment of this disclosure.

FIG. 1 is a schematic view of the image forming apparatus 2000 according to an embodiment of this disclosure.

The image forming apparatus 2000 herein serves as a tandem-type multicolor printer to form a full-color toner image by superimposing toner images of four fundamental colors (black, cyan, magenta, and yellow) and an auxiliary color one atop another.

The image forming apparatus 2000 includes three optical scanning devices 2010A1, 2010A2 and 2010T, five photoconductive drums 2030K, 2030C, 2030M, 2030Y, and 2030T (hereinafter collectively referred to as photoconductive drums 2030), five drum cleaning devices 2031K, 2031C, 2031M, 2031Y, and 2031T (hereinafter collectively referred to as drum cleaning devices 2031), five charging devices 2032K, 2032C, 2032M, 2032Y, and 2032T (hereinafter collectively referred to as charging devices 2032), and five developing devices 2033K, 2033C, 2033M, 2033Y, and 2033T (hereinafter collectively referred to as developing devices 2033).

The image forming apparatus 2000 further includes a transfer belt 2040, a fixing device 2050, a pair of registration rollers 2056, a transfer roller 2041, a pair of sheet-discharging rollers 2058, a sheet-feeding tray 2060, and a sheet-discharging tray 2070. In addition, the image forming apparatus 2000 includes, a communication control device 2080, a belt cleaning device 2085, a mark position detector 2245, and a control device 2090. The control device 2090 generally controls the foregoing components.

The image forming apparatus 2000 has a copying capability, in addition to a printing capability, with a scanner 2001. It is to be noted that, in three-dimensional orthogonal coordinates XYZ, a direction of axis X (hereinafter referred to as direction X) is a direction in which the photoconductive drums 2030 are arrayed, and a direction of axis Y (hereinafter referred to as direction Y) is a longitudinal direction of the photoconductive drums 2030.

The communication control device 2080 controls communication between the image forming apparatus 2000 and an upstream device 100 (e.g., personal computer) via a network or the like.

The photoconductive drums 2030 have a photoconductive layer on their respective surfaces to be irradiated. It is to be noted that the photoconductive drums 2030 are rotated by a rotation mechanism in a direction indicated by arrow A (hereinafter referred to as rotational direction A) in FIG. 1.

The photoconductive drum 2030K is surrounded by the charging device 2032K, the developing device 2033K, and the drum cleaning device 2031K, disposed along the rotational direction A.

An imaging station 2039K includes the photoconductive drum 2030K, the charging device 2032K, the developing device 2033K, and the drum cleaning device 2031K to form a black toner image.

The photoconductive drum 2030C is surrounded by the charging device 2032C, the developing device 2033C, and the drum cleaning device 2031C, disposed along the rotational direction A.

An imaging station 2039C includes the photoconductive drum 2030C, the charging device 2032C, the developing device 2033C, and the drum cleaning device 2031C to form a cyan toner image.

The photoconductive drum 2030M is surrounded by the charging device 2032M, the developing device 2033M, and the drum cleaning device 2031M, disposed along the rotational direction A.

An imaging station 2039M includes the photoconductive drum 2030M, the charging device 2032M, the developing device 2033M, and the drum cleaning device 2031M to form a magenta toner image.

The photoconductive drum 2030Y is surrounded by the charging device 2032Y, the developing device 2033Y, and the drum cleaning device 2031Y, disposed along the rotational direction A.

An imaging station 2039Y includes the photoconductive drum 2030Y, the charging device 2032Y, the developing device 2033Y, and the drum cleaning device 2031Y to form a yellow toner image.

The photoconductive drum 2030T is surrounded by the charging device 2032T, the developing device 2033T, and the drum cleaning device 2031T, disposed along the rotational direction A.

An imaging station 2039T includes the photoconductive drum 2030T, the charging device 2032T, the developing device 2033T, and the drum cleaning device 2031T to form a toner image of the auxiliary color.

The charging devices 2032 evenly charge the surfaces of the photoconductive drums 2030.

The optical scanning device 2010A1, serving as a first optical scanning device, irradiates the charged surface of the photoconductive drum 2030C with luminous flux Lc modulated according to cyan image data from the control device 2090. Hence, electric charges are eliminated from an irradiated portion of the surface of the photoconductive drum 2030C. Thus, a latent image is formed according to the cyan image data on the surface of the photoconductive drum 2030C. The rotation of the photoconductive drum 2030C moves the latent image thus formed to the developing device 2033C.

The optical scanning device 2010A1 also irradiates the charged surface of the photoconductive drum 2030K with luminous flux Lk modulated according to black image data. Hence, electric charges are eliminated from an irradiated portion of the surface of the photoconductive drum 2030K. Thus, a latent image is formed according to the black image data on the surface of the photoconductive drum 2030K. The rotation of the photoconductive drum 2030K moves the latent image thus formed to the developing device 2033K.

The optical scanning device 2010A2, serving as a second optical scanning device, irradiates the charged surface of the photoconductive drum 2030Y with luminous flux Ly modulated according to yellow image data from the control device 2090. Hence, electric charges are eliminated from an irradiated portion of the surface of the photoconductive drum 2030Y. Thus, a latent image is formed according to the yellow image data on the surface of the photoconductive drum 2030Y. The rotation of the photoconductive drum 2030Y moves the latent image thus formed to the developing device 2033Y.

The optical scanning device 2010A2 also irradiates the charged surface of the photoconductive drum 2030M with luminous flux Lm modulated according to magenta image data. Thus, electric charges are eliminated from an irradiated portion of the surface of the photoconductive drum 2030M. Accordingly, a latent image is formed according to the magenta image data on the surface of the photoconductive drum 2030M. The rotation of the photoconductive drum 2030M moves the latent image thus formed to the developing device 2033M.

It is to be noted that the optical scanning devices 2010A1 and 2010A2 are hereinafter collectively referred to as optical scanning device 2010A unless otherwise required.

The optical scanning device 2010T, serving as a third optical scanning device, irradiates the charged surface of the photoconductive drum 2030T with luminous flux Lt modulated according to image data of the auxiliary color. Thus, electric charges are eliminated from an irradiated portion of the surface of the photoconductive drum 2030T. Accordingly, a latent image is formed according to the image data of the auxiliary color on the surface of the photoconductive drum 2030T. The rotation of the photoconductive drum 2030T moves the latent image thus formed to the developing device 2033T.

It is to be noted that descriptions of configurations of the optical scanning devices 2010A and 2010T are given later.

The developing devices 2033 develop the latent images thus formed on the surfaces of the photoconductive drums 2030 with toner of the respective colors, thereby forming visible images, also known as toner images of the respective colors.

The rotation of the photoconductive drums 2030 moves the respective toner images thus developed toward the transfer belt 2040. Then, the toner images are sequentially transferred and superimposed one atop another on the transfer belt 2040 in a predetermined timing.

The sheet-feeding tray 2060 accommodates recording sheets. The recording sheets are conveyed to the pair of registration rollers 2056, one by one, from the sheet-feeding tray 2060 by a sheet-feeding roller disposed near the sheet-feeding tray 2060. The pair of registration rollers 2056 sends out the conveyed recording sheet toward a gap between the transfer belt 2040 and the transfer roller 2041 in a predetermined timing.

Then, the toner images superimposed on the transfer belt 2040 are transferred onto the recording sheet. The recording sheet bearing the toner images is then conveyed to the fixing device 2050.

The fixing device 2050 applies heat and pressure to the recording sheet to fix the toner images onto the recording sheet to form a full-color toner image. The recording sheet bearing the full-color toner image is conveyed to the sheet-discharging tray 2070 via the pair of sheet-discharging rollers 2058. Thus, the recording sheets sequentially rest on the sheet-discharging tray 2070.

The drum cleaning devices 2031 remove residual toner remaining on the surfaces of the photoconductive drums 2030 after a transfer process. The surfaces of the photoconductive drums 2030 from which the residual toner is removed return to a position facing the charging devices 2032. The belt cleaning device 2085 removes residual toner remaining on an outer surface of the transfer belt 2040 after the toner images are transferred from the transfer belt 2040 to the recording sheet.

Figure 2:
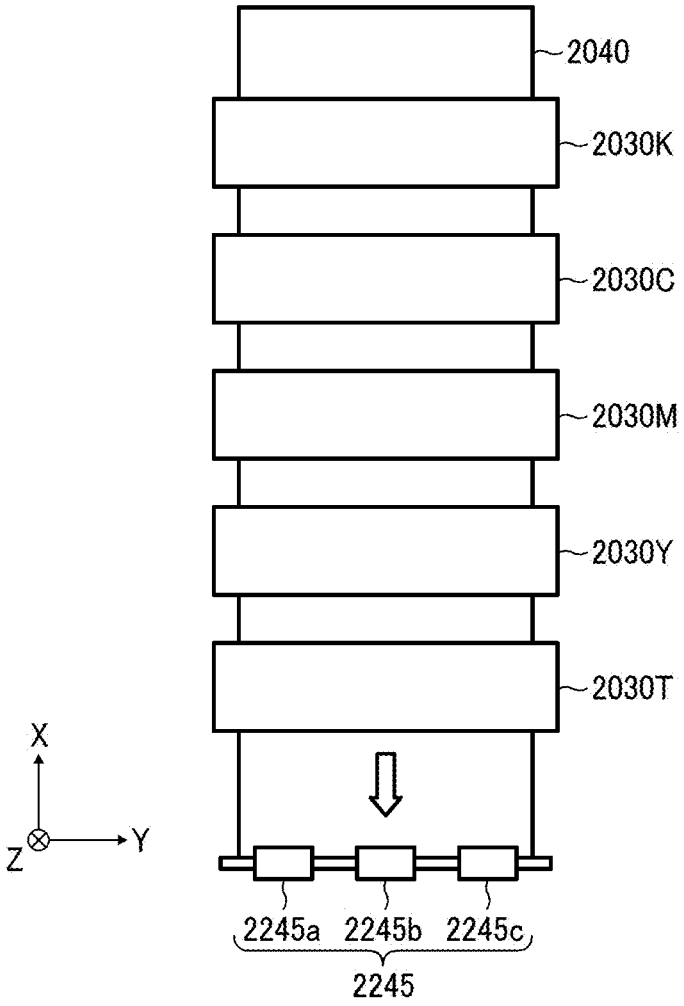
FIG. 2 is a schematic view of a mark position detector and associated components incorporated in the image forming apparatus illustrated in FIG. 1.

Referring now to FIGS. 1 and 2, a description is given of the mark position detector 2245 incorporated in the image forming apparatus 2000 described above.

FIG. 2 is a schematic view of the mark position detector 2245 and associated components, such as the transfer belt 2040 and the photoconductive drums 2030.

The mark position detector 2245 is disposed near a left end of the transfer belt 2040 in FIG. 1. As illustrated in FIG. 2, the mark position detector 2245 includes, e.g., three optical sensors 2245*a*, 2245*b*, and 2245*c*. Each of the optical sensors 2245*a* and 2245*c* is disposed facing about a respective lateral edge of the transfer belt 2040 in a width direction of the transfer belt 2040 (i.e., direction Y). The optical sensor 2245*b* is disposed facing about the center of the transfer belt 2040 in the width direction of the transfer belt 2040.

Each of the optical sensors 2245*a*, 2245*b*, and 2245*c* has, e.g., a light source to emit light and a light receiving element to receive the light reflected by the transfer belt 2040, and notifies the control device 2090 of positional data of marks transferred onto the transfer belt 2040.

Referring now to FIGS. 3 to 6, a detailed description is given of the configuration of the optical scanning device 2010A1.

Figure 3:
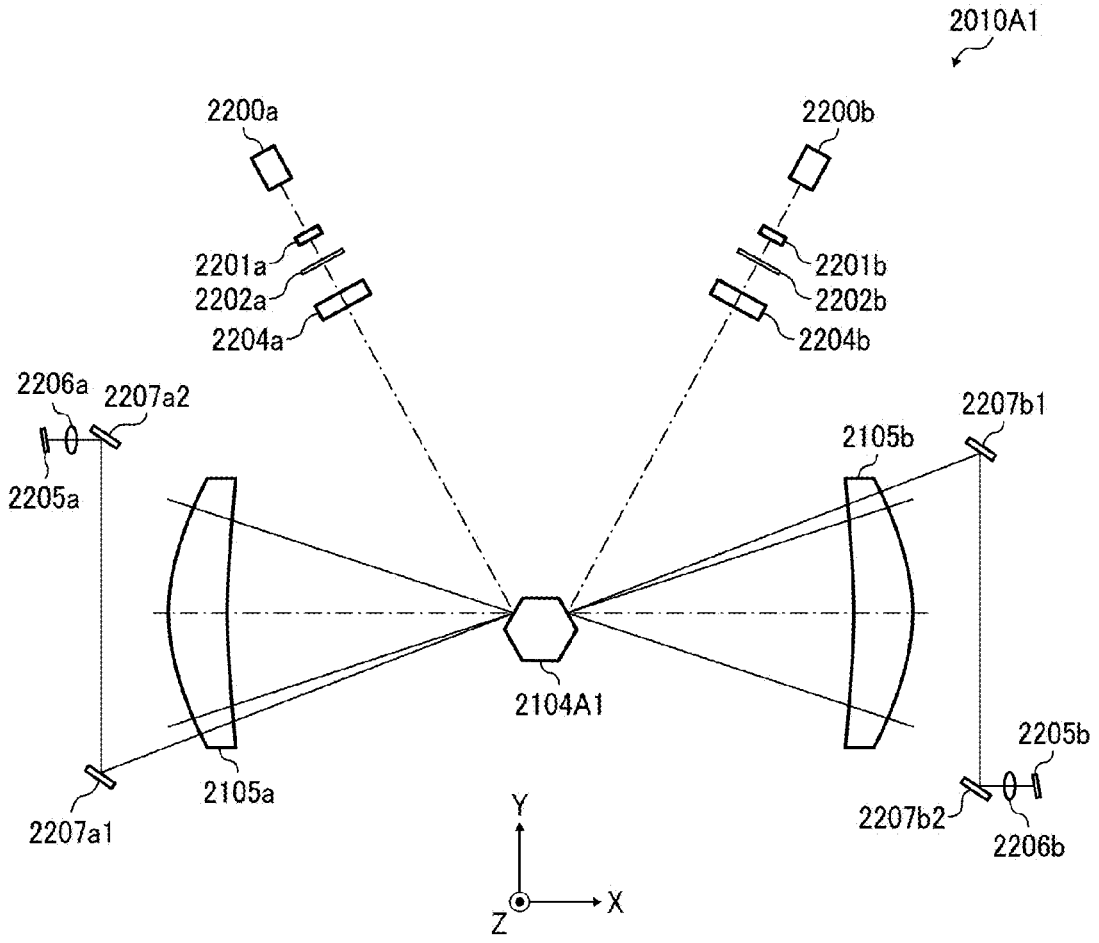
FIG. 3 is a schematic view of a first optical scanning device incorporated in the image forming apparatus illustrated in FIG. 1.

FIG. 3 is a schematic view of the optical scanning device 2010A1 incorporated in the image forming apparatus illustrated in FIG. 1.

The optical scanning device 2010A1 includes, e.g., two light sources 2200*a* and 2200*b*, two coupling lenses 2201*a* and 2201*b*, two aperture plates 2202*a* and 2202*b*, two line-image forming lenses 2204*a* and 2204*b*, respectively, a polygon mirror 2104A1 serving as a first deflector, two first scanning lenses 2105*a* and 2105*b* disposed near the polygon mirror 2104A1, two second scanning lenses 2107*a* and 2107*b* disposed near an image plane (see FIG. 6), four reflecting mirrors 2106*a*, 2106*b*, 2108*a*, and 2108*b* (see FIG. 6), two optical sensors 2205*a* and 2205*b*, two condensing lenses 2206*a* and 2206*b*, four optical detection mirrors 2207*a*1, 2207*a*2, 2207*b*1, and 2207*b*2, and a scanning control device. The foregoing optical elements are installed at predetermined positions in an optical housing 2210CK, serving as a first optical housing, illustrated in FIG. 16.

Figure 7:
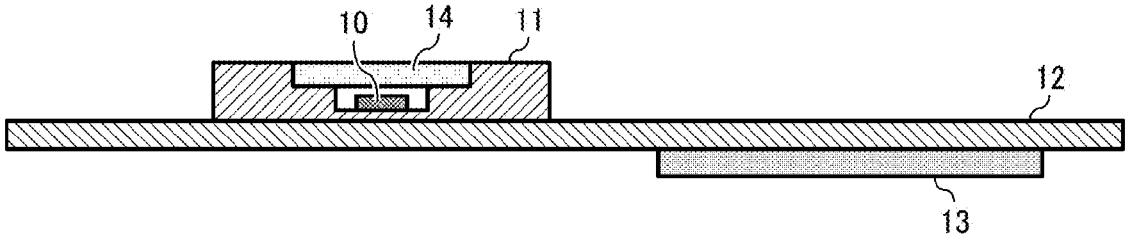
FIG. 7 is a schematic view of a light source of the first optical scanning device illustrated in FIG. 3.

Referring now to FIGS. 3 and 7, a detailed description is given of the light sources 2200*a* and 2200*b*.

As illustrated in FIG. 3, the light sources 2200*a* and 2200*b* are disposed separately from each other in the direction X as seen from a direction of axis Z (hereinafter referred to as direction Z). Each of the light sources 2200*a* and 2200*b* has a configuration as illustrated in FIG. 7. More specifically, each of the light sources 2200*a* and 2200*b* includes, e.g., a surface emitting laser chip 10, a package 11 to hold the surface emitting laser chip 10, and a cover glass 14 to protect the surface emitting laser chip 10.

The package 11 is mounted on a front face of a circuit substrate 12. A driving chip 13 is mounted on a back face of the circuit substrate 12 to drive the surface emitting laser chip 10. The surface emitting laser chip 10 and the package 11 are electrically connected to each other by a bonding wire.

Figure 8:
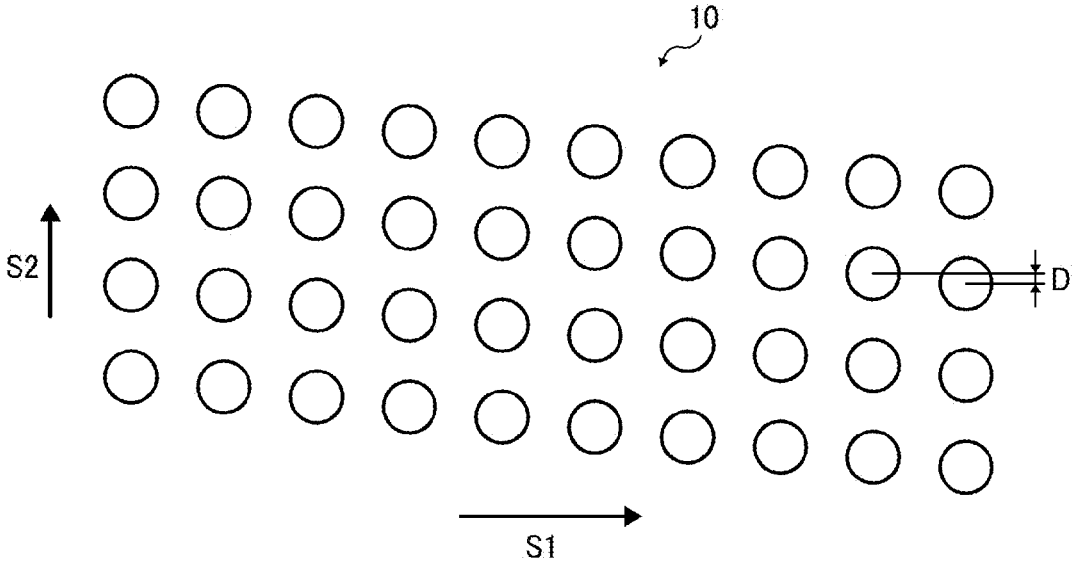
FIG. 8 is an enlarged view of a surface emitting laser chip illustrated in FIG. 7.

Referring now to FIG. 8, a detailed description is given of the surface emitting laser chip 10 described above.

FIG. 8 is an enlarged view of the surface emitting laser chip 10.

The surface emitting laser chip 10 is, e.g., a vertical-cavity surface-emitting laser array, or VCSEL array, in which 40 VCSELs serving as light emitters are bidimensionally arrayed on a substrate. Each VCSEL has an oscillation wavelength of 780-nm. If all 40 of the VCSELs are orthogonally projected on a virtual line extending in the direction Z, the projected VCSELs are arrayed at an equal interval D. It is to be noted that the interval D is an interval between the centers of two adjacent VCSELs.

Figure 4:
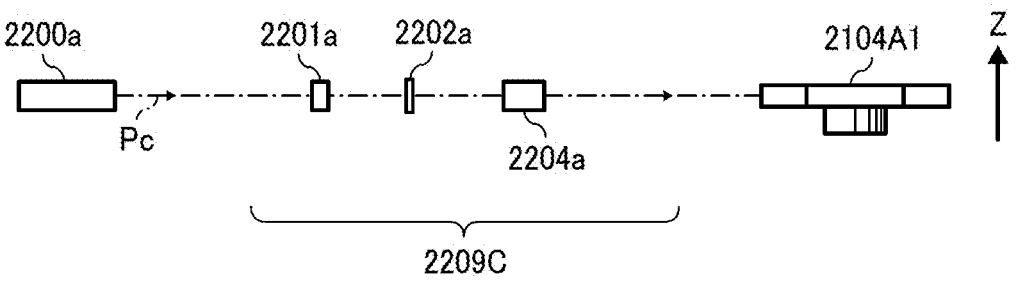
FIG. 4 is a partially enlarged view of the first optical scanning device illustrated in FIG. 3.

Referring now to FIG. 4, a description is given of an optical system 2209C.

FIG. 4 is a partially enlarged view of the optical scanning device 2010A1, illustrating the optical system 2209C.

The optical system 2209C includes, e.g., the coupling lens 2201*a*, the aperture plate 2202*a*, and the line-image forming lens 2204*a*, disposed on an optical path Pc between the light source 2200*a* and the polygon mirror 2104A1.

The coupling lens 2201*a* is disposed on the optical path Pc of the luminous flux Lc emitted by the light source 2200*a* to turn the luminous flux Lc into substantially parallel luminous flux Lc. The coupling lens 2201*a* has a refraction index of about 1.5 with respect to the luminous flux Lc emitted by the light source 2200*a*.

The aperture plate 2202*a* has an opening to limit the amount of luminous flux Lc passing through the coupling lens 2201*a*. The opening of the aperture plate 2202*a* has a rectangular shape with a width of about 5.5 mm in a direction corresponding to a main scanning direction (hereinafter referred to as direction S1) and a width of about 1.18 mm in a direction corresponding to a sub-scanning direction (hereinafter referred to as direction S2). The aperture plate 2202*a* is disposed such that the center of the opening is located in a focal position of the coupling lens 2201*a* or the vicinity thereof.

The line-image forming lens 2204*a* images the luminous flux Lc passing through the opening of the aperture plate 2202*a* on a reflective surface of the polygon mirror 2104A1 or the vicinity thereof, in the direction Z, via a neutral density filter, or ND filter, to adjust light utilization efficiency. The line-image forming lens 2204*a* is an anamorphic lens having a first face on an incident side and a second face on an emitting side. The first face has a refractive power in the direction S2. The second face has a refractive power in the direction S1.

Figure 5:
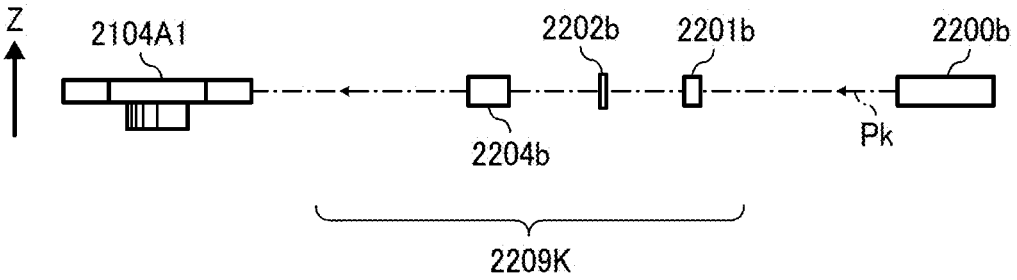
FIG. 5 is another partially enlarged view of the first optical scanning device illustrated in FIG. 3.

Referring now to FIG. 5, a description is given of an optical system 2209K.

FIG. 5 is a partially enlarged view of the optical scanning device 2010A1, illustrating the optical system 2209K.

The optical system 2209K includes, e.g., the coupling lens 2201*b*, the aperture plate 2202*b*, and the line-image forming lens 2204*b*, disposed on an optical path Pk between the light source 2200*b* and the polygon mirror 2104A1.

The coupling lens 2201*b* is disposed on the optical path Pk of luminous flux Lk emitted by the light source 2200*b* to turn the luminous flux Lk into substantially parallel luminous flux Lk. The coupling lens 2201*b* has a refraction index of about 1.5 with respect to the luminous flux Lk emitted by the light source 2200*b*.

The aperture plate 2202*b* has an opening to limit the amount of luminous flux Lk passing through the coupling lens 2201*b*. The opening of the aperture plate 2202*b* has a rectangular shape with a width of about 5.5 mm in the direction S1 and a width of about 1.18 mm in the direction S2. The aperture plate 2202*b* is disposed such that the center of the opening is located in a focal position of the coupling lens 2201*b* or the vicinity thereof.

The line-image forming lens 2204*b* images the luminous flux Lk passing through the opening of the aperture plate 2202*b* on another reflective surface of the polygon mirror 2104A1 or the vicinity thereof, in the direction Z, via an ND filter to adjust light utilization efficiency. The line-image forming lens 2204*b* is an anamorphic lens having a first face on an incident side and a second face on an emitting side. The first face has a refractive power in the direction S2. The second face has a refractive power in the direction S1.

The polygon mirror 2104A1 is, e.g., a hexagon having six deflection surfaces and rotatable about its axis parallel to the direction Z. A circle inscribed within the hexagon has a radius of, e.g., about 25 mm. The luminous flux Lc from the line-image forming lens 2204*a* is deflected by the polygon mirror 2104A1 toward a minus X (−X) side of the polygon mirror 2104A1. By contrast, the luminous flux Lk from the line-image forming lens 2204*b* is deflected by the polygon mirror 2104A1 toward a plus X (+X) side of the polygon mirror 2104A1.

Figure 6:
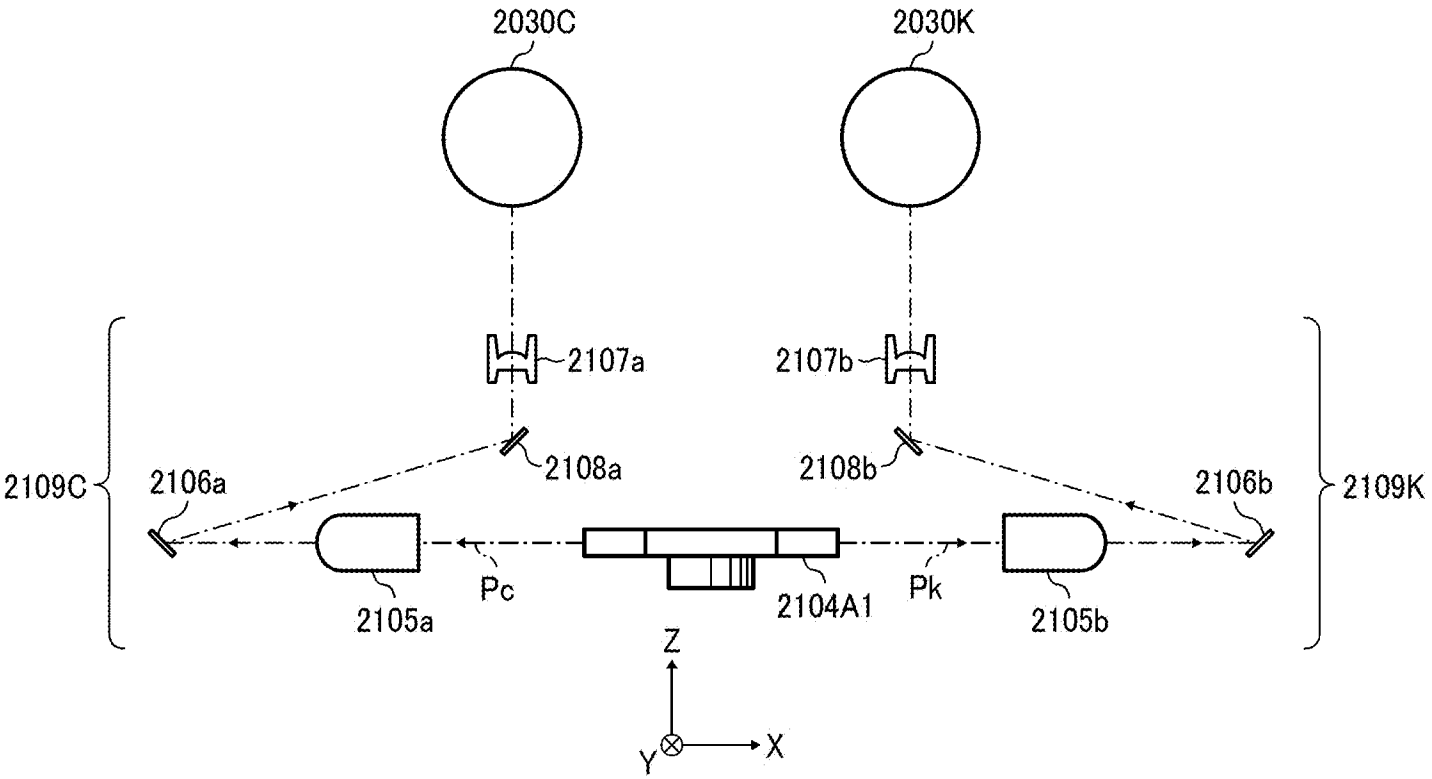
FIG. 6 is yet another partially enlarged view of the first optical scanning device illustrated in FIG. 3.

Referring to FIG. 6, a description is given of scanning optical systems 2109C and 2109K.

FIG. 6 is a partially enlarged view of the optical scanning device 2010A1, illustrating the scanning optical systems 2109C and 2109K.

The scanning optical system 2109C includes, e.g., the first scanning lens 2105*a*, the reflecting mirrors 2106*a* and 2108*a*, and the second scanning lens 2107*a*, disposed on the optical path Pc between the polygon mirror 2104A1 and the photoconductive drum 2030C. The scanning optical system 2109K includes, e.g., the scanning lens 2105*b*, the reflecting mirrors 2106*b* and 2108*b*, and the scanning lens 2107*b*, disposed on the optical path Pk between the polygon mirror 2104A1 and the photoconductive drum 2030K.

First, a description is given of the scanning optical system 2109C.

The first scanning lens 2105*a* is disposed near the polygon mirror 2104A1, on the −X side of the polygon mirror 2104A1. The reflecting mirror 2106*a* is disposed to turn the optical path Pc of the luminous flux Lc passing through the first scanning lens 2105*a* toward the reflecting mirror 2108*a*. The reflecting mirror 2108*a* is disposed to turn the optical path Pc turned by the reflecting mirror 2106*a* toward the photoconductive drum 2030C. The second scanning lens 2107*a* is disposed on the optical path Pc between the reflecting mirror 2108*a* and the photoconductive drum 2030C.

Accordingly, the surface of the photoconductive drum 2030C is irradiated with the luminous flux Lc passing through the line-image forming lens 2204*a* and deflected by the polygon mirror 2104A1, via the first scanning lens 2105*a*, the reflecting mirrors 2106*a* and 2108*a*, and the second scanning lens 2107*a* in this order. Thus, an optical spot is formed on the surface of the photoconductive drum 2030C.

Rotation of the polygon mirror 2104A1 moves the optical spot thus formed in the longitudinal direction of the photoconductive drum 2030C. Thus, the surface of the photoconductive drum 2030C is irradiated. The optical spot moves on the surface of the photoconductive drum 2030C in a main scanning direction of the photoconductive drum 2030C. The photoconductive drum 2030C rotates in a sub-scanning direction of the photoconductive drum 2030C.

Next, a description is given of the scanning optical system 2109K.

The first scanning lens 2105*b* is disposed near the polygon mirror 2104A1, on the +X side of the polygon mirror 2104A1. The reflecting mirror 2106*b* is disposed to turn the optical path Pk of the luminous flux Lk passing through the first scanning lens 2105*b* toward the reflecting mirror 2108*b*. The reflecting mirror 2108*b* is disposed to turn the optical path Pk turned by the reflecting mirror 2106*b* toward the photoconductive drum 2030K. The second scanning lens 2107*b* is disposed on the optical path Pk between the reflecting mirror 2108*b* and the photoconductive drum 2030K.

Accordingly, the surface of the photoconductive drum 2030K is irradiated with the luminous flux Lk passing through the line-image forming lens 2204*b* and deflected by the polygon mirror 2104A1, via the first scanning lens 2105*b*, the reflecting mirrors 2106*b* and 2108*b*, and the second scanning lens 2107*b* in this order. Thus, an optical spot is formed on the surface of the photoconductive drum 2030K.

Rotation of the polygon mirror 2104A1 moves the optical spot thus formed in the longitudinal direction of the photoconductive drum 2030K. Thus, the surface of the photoconductive drum 2030K is irradiated. The optical spot moves on the surface of the photoconductive drum 2030K in a main scanning direction of the photoconductive drum 2030K. The photoconductive drum 2030K rotates in a sub-scanning direction of the photoconductive drum 2030K.

The reflecting mirrors 2106*a*, 2108*a*, 2106*b*, and 2108*b* are disposed such that the optical path Pc reaching the photoconductive drum 2030C from the polygon mirror 2104A1 is as long as the optical path Pk reaching the photoconductive drum 2030K from the polygon mirror 2104A1, and that the luminous flux Lc and Lk enter the photoconductive drums 2030C and 2030K at the same position and the same angle, respectively.

The two scanning optical systems 2109C and 2109K are symmetrically configured. The polygon mirror 2104A1 scans the luminous flux Lc and Lk from the respective light sources 2200*a* and 2200*b* in an optically symmetrical manner.

Referring back to FIG. 3, after the luminous flux Lc is deflected by the polygon mirror 2104A1 and passes through the first scanning lens 2105*a*, part of the luminous flux Lc before writing enters the optical sensor 2205*a* via the optical detection mirrors 2207*a*1 and 2207*a*2, and the condensing lens 2206*a*. Similarly, after the luminous flux Lk is deflected by the polygon mirror 2104A1 and passes through the first scanning lens 2105*b*, part of the luminous flux Lk before writing enters the optical sensor 2205*b* via the optical detection mirrors 2207*b*1 and 2207*b*2, and the condensing lens 2206*b*. The optical sensors 2205*a* and 2205*b* output signals corresponding to the amount of light received. The scanning control device detects when to start writing on the photoconductive drums 2030C and 2030K according to the signals (synchronization detection signals) outputted by the optical sensors 2205*a* and 2205*b*, respectively.

Referring now to FIGS. 9 to 12, a detailed description is given of the configuration of the optical scanning device 2010A2.

Figure 9:
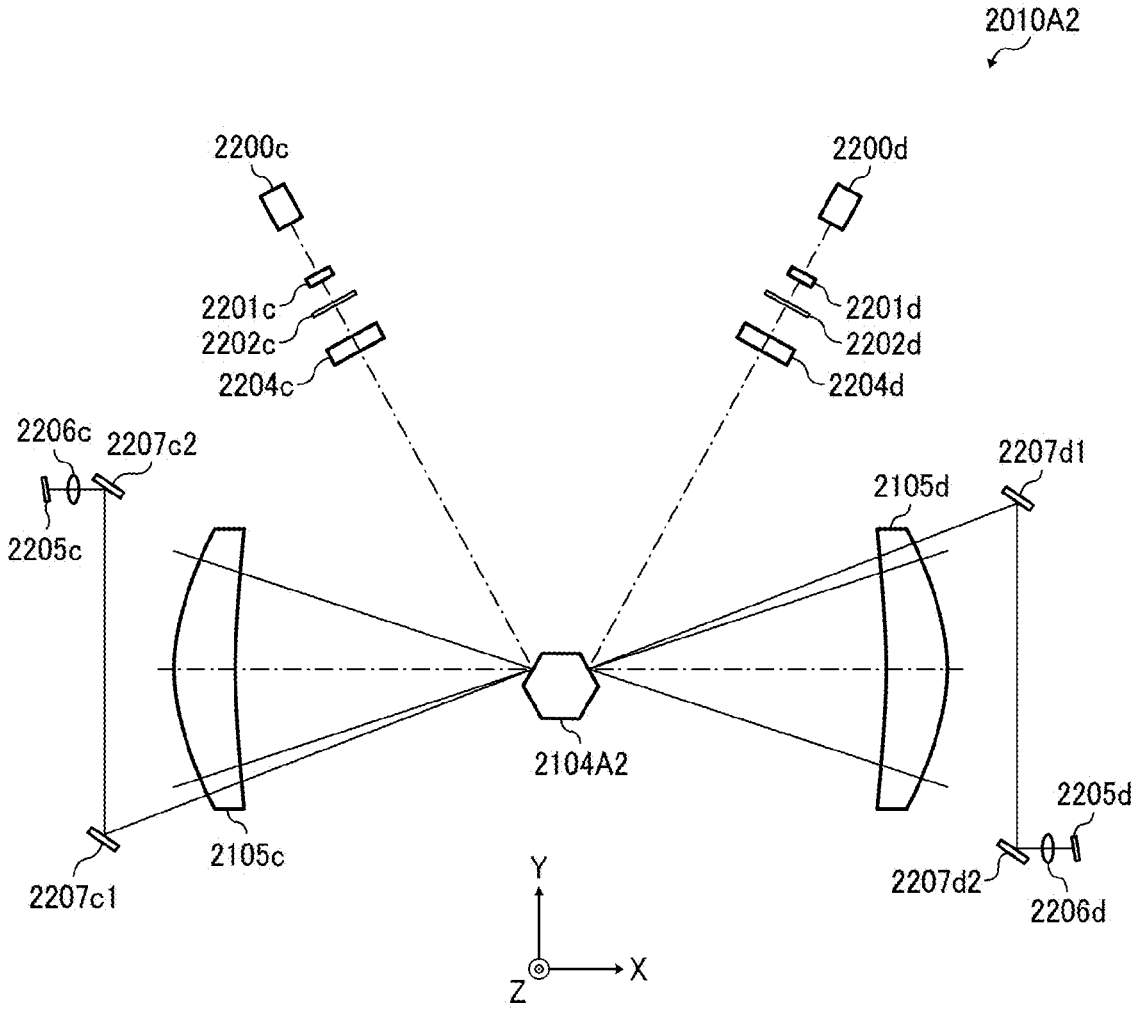
FIG. 9 is a schematic view of a second optical scanning device incorporated in the image forming apparatus illustrated in FIG. 1.

FIG. 9 is a schematic view of the optical scanning device 2010A2 incorporated in the image forming apparatus illustrated in FIG. 1.

The optical scanning device 2010A2 includes, e.g., two light sources 2200*c* and 2200*d*, two coupling lenses 2201*c* and 2201*d*, two aperture plates 2202*c* and 2202*d*, two line-image forming lenses 2204*c* and 2204*d*, respectively, a polygon mirror 2104A2 serving as a second deflector, two first scanning lenses 2105*c* and 2105*d* disposed near the polygon mirror 2104A2, two second scanning lenses 2107*c* and 2107*d* disposed near an image plane (see FIG. 12), four reflecting mirrors 2106*c*, 2106*d*, 2108*c*, and 2108*d* (see FIG. 12), two optical sensors 2205*c* and 2205*d*, two condensing lenses 2206*c* and 2206*d*, four optical detection mirrors 2207*c*1, 2207*c*2, 2207*d*1, and 2207*d*2, and a scanning control device. The foregoing optical elements are installed at predetermined positions in an optical housing 2210YM, serving as a second optical housing, that has the same shape and configuration as the optical housing 2210CK illustrated in FIG. 16.

The light sources 2200*c* and 2200*d* are disposed separately from each other in the direction X as seen from the direction Z. The light sources 2200*c* and 2200*d* are similar to the light sources 2200*a* and 2200*b*.

Figure 10:
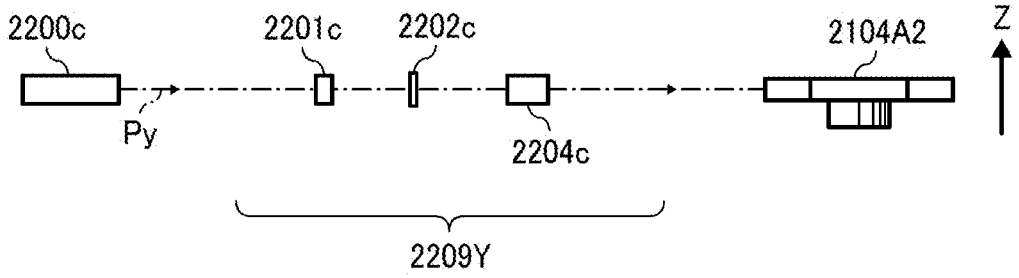
FIG. 10 is a partially enlarged view of the second optical scanning device illustrated in FIG. 9.

Referring now to FIG. 10, a description is given of an optical system 2209Y.

FIG. 10 is a partially enlarged view of the optical scanning device 2010A2, illustrating the optical system 2209K.

The optical system 2209Y includes, e.g., the coupling lens 2201*c*, the aperture plate 2202*c*, and the line-image forming lens 2204*c*, disposed on an optical path Py between the light source 2200*c* and the polygon mirror 2104A2.

The coupling lens 2201*c* is disposed on the optical path Py of the luminous flux Ly emitted by the light source 2200*c* to turn the luminous flux Ly into substantially parallel luminous flux Ly. The coupling lens 2201*c* has a refraction index of about 1.5 with respect to the luminous flux Ly emitted by the light source 2200*c*.

The aperture plate 2202*c* has an opening to limit the amount of luminous flux Ly passing through the coupling lens 2201*c*. The opening of the aperture plate 2202*c* has a rectangular shape with a width of about 5.5 mm in the direction S1 and a width of about 1.18 mm in the direction S2. The aperture plate 2202*c* is disposed such that the center of the opening is located in a focal position of the coupling lens 2201*c* or the vicinity thereof.

The line-image forming lens 2204*c* images the luminous flux Ly passing through the opening of the aperture plate 2202*c* on a reflective surface of the polygon mirror 2104A2 or the vicinity thereof, in the direction Z, via an ND filter to adjust light utilization efficiency. The line-image forming lens 2204*c* is an anamorphic lens having a first face on an incident side and a second face on an emitting side. The first face has a refractive power in the direction S2. The second face has a refractive power in the direction S1.

Figure 11:
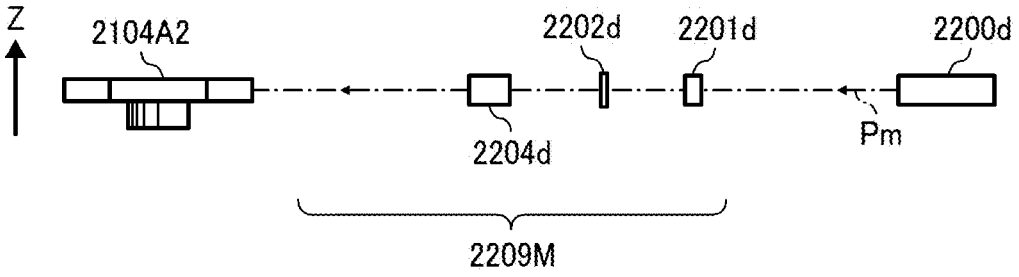
FIG. 11 is another partially enlarged view of the second optical scanning device illustrated in FIG. 9.

Referring now to FIG. 11, a description is given of an optical system 2209M.

FIG. 11 is a partially enlarged view of the optical scanning device 2010A2, illustrating the optical system 2209M.

The optical system 2209M includes, e.g., the coupling lens 2201*d*, the aperture plate 2202*d*, and the line-image forming lens 2204*d*, disposed on an optical path Pm between the light source 2200*d* and the polygon mirror 2104A2.

The coupling lens 2201*d* is disposed on the optical path Pm of the luminous flux Lm emitted by the light source 2200*d* to turn the luminous flux Lm into substantially parallel luminous flux Lm. The coupling lens 2201*d* has a refraction index of about 1.5 with respect to the luminous flux Lm emitted by the light source 2200*d*.

The aperture plate 2202*d* has an opening to limit the amount of luminous flux Lm passing through the coupling lens 2201*d*. The opening of the aperture plate 2202*d* has a rectangular shape with a width of about 5.5 mm in the direction S1 and a width of about 1.18 mm in the direction S2. The aperture plate 2202*d* is disposed such that the center of the opening is located in a focal position of the coupling lens 2201*d* or the vicinity thereof.

The line-image forming lens 2204*d* images the luminous flux Lm passing through the opening of the aperture plate 2202*d* on another reflective surface of the polygon mirror 2104A2 or the vicinity thereof, in the direction Z, via an ND filter to adjust light utilization efficiency. The line-image forming lens 2204*d* is an anamorphic lens having a first face on an incident side and a second face on an emitting side. The first face has a refractive power in the direction S2. The second face has a refractive power in the direction S1.

The polygon mirror 2104A2 is, e.g., a hexagon having six deflection surfaces and rotatable about its axis parallel to the direction Z. A circle inscribed within the hexagon has a radius of, e.g., about 25 mm. The luminous flux Ly from the line-image forming lens 2204*c* is deflected by the polygon mirror 2104A2 toward the −X side of the polygon mirror 2104A2. By contrast, the luminous flux Lm from the line-image forming lens 2204*d* is deflected by the polygon mirror 2104A2 toward the +X side of the polygon mirror 2104A2.

Figure 12:
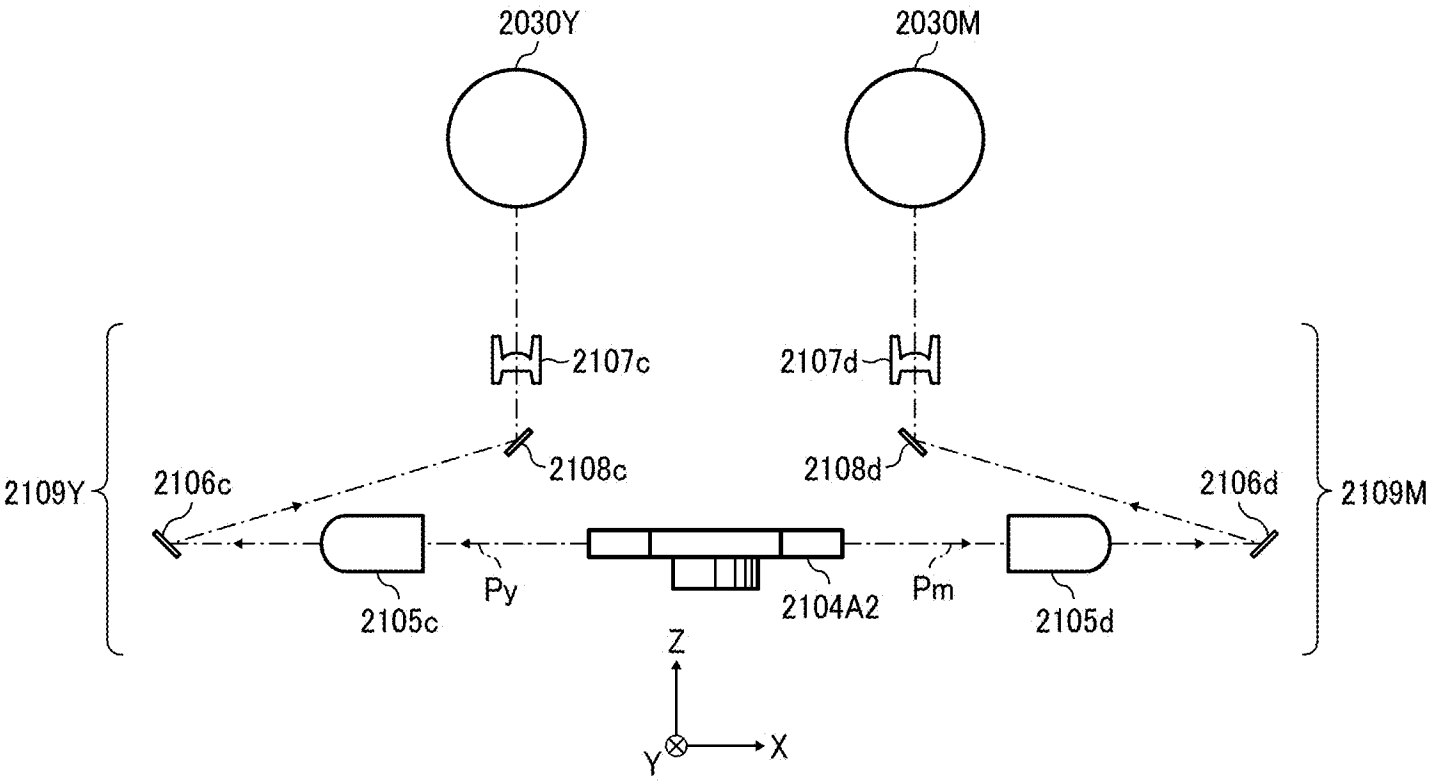
FIG. 12 is yet another partially enlarged view of the first optical scanning device illustrated in FIG. 9.

Referring to FIG. 12, a description is given of scanning optical systems 2109Y and 2109M.

FIG. 12 is a partially enlarged view of the optical scanning device 2010A2, illustrating the scanning optical systems 2109Y and 2109M.

The scanning optical system 2109Y includes, e.g., the first scanning lens 2105*c*, the reflecting mirrors 2106*c* and 2108*c*, and the second scanning lens 2107*c*, disposed on the optical path Py between the polygon mirror 2104A2 and the photoconductive drum 2030Y. The scanning optical system 2109M includes, e.g., the first scanning lens 2105*d*, the reflecting mirrors 2106*d* and 2108*d*, and the second scanning lens 2107*d*, disposed on the optical path Pm between the polygon mirror 2104A2 and the photoconductive drum 2030M.

First, a description is given of the scanning optical system 2109Y.

The first scanning lens 2105*c* is disposed near the polygon mirror 2104A2, on the −X side of the polygon mirror 2104A2. The reflecting mirror 2106*c* is disposed to turn the optical path Py of the luminous flux Ly passing through the first scanning lens 2105*c* toward the reflecting mirror 2108*c*. The reflecting mirror 2108*c* is disposed to turn the optical path Py turned by the reflecting mirror 2106*c* toward the photoconductive drum 2030Y. The second scanning lens 2107*c* is disposed on the optical path Py between the reflecting mirror 2108*c* and the photoconductive drum 2030Y.

Accordingly, the surface of the photoconductive drum 2030Y is irradiated with the luminous flux Ly passing through the line-image forming lens 2204*c* and deflected by the polygon mirror 2104A2, via the first scanning lens 2105*c*, the reflecting mirrors 2106*c* and 2108*c*, and the second scanning lens 2107*c* in this order. Thus, an optical spot is formed on the surface of the photoconductive drum 2030Y.

Rotation of the polygon mirror 2104A2 moves the optical spot thus formed in the longitudinal direction of the photoconductive drum 2030Y. Thus, the surface of the photoconductive drum 2030Y is irradiated. The optical spot moves on the surface of the photoconductive drum 2030Y in a main scanning direction of the photoconductive drum 2030Y. The photoconductive drum 2030Y rotates in a sub-scanning direction of the photoconductive drum 2030Y.

Next, a description is given of the scanning optical system 2109M.

The first scanning lens 2105*d* is disposed near the polygon mirror 2104A2, on the +X side of the polygon mirror 2104A2. The reflecting mirror 2106*d* is disposed to turn the optical path Pm of the luminous flux Lm passing through the first scanning lens 2105*d* toward the reflecting mirror 2108*d*. The reflecting mirror 2108*d* is disposed to turn the optical path Pm turned by the reflecting mirror 2106*d* toward the photoconductive drum 2030M. The second scanning lens 2107*d* is disposed on an optical path Pm between the reflecting mirror 2108*d* and the photoconductive drum 2030M.

Accordingly, the surface of the photoconductive drum 2030M is irradiated with the luminous flux Lm passing through the line-image forming lens 2204*d* and deflected by the polygon mirror 2104A2, via the first scanning lens 2105*d*, the reflecting mirrors 2106*d* and 2108*d*, and the second scanning lens 2107*d* in this order. Thus, an optical spot is formed on the surface of the photoconductive drum 2030M.

Rotation of the polygon mirror 2104A2 moves the optical spot thus formed in the longitudinal direction of the photoconductive drum 2030M. Thus, the surface of the photoconductive drum 2030M is irradiated. The optical spot moves on the surface of the photoconductive drum 2030M in a main scanning direction of the photoconductive drum 2030M. The photoconductive drum 2030M rotates in a sub-scanning direction of the photoconductive drum 2030M.

The reflecting mirrors 2106*c*, 2108*c*, 2106*d*, and 2108*d* are disposed such that the optical path Py reaching the photoconductive drum 2030Y from the polygon mirror 2104A2 is as long as the optical path Pm reaching the photoconductive drum 2030M from the polygon mirror 2104A2, and that the luminous flux Ly and Lm enter the photoconductive drums 2030Y and 2030M at the same position and the same angle, respectively.

The two scanning optical systems 2109Y and 2109M are symmetrically configured. The polygon mirror 2104A2 scans the luminous flux Ly and Lm from the respective light sources 2200*c* and 2200*d* in an optically symmetrical manner. A set of the scanning optical systems 2109C and 2109K can be configured to be optically the same as a set of the scanning optical systems 2109Y and 2109M.

Referring back to FIG. 9, after the luminous flux Ly is deflected by the polygon mirror 2104A2 and passes through the first scanning lens 2105*c*, part of the luminous flux Ly before writing enters the optical sensor 2205*c* via the optical detection mirrors 2207*c*1 and 2207*c*2, and the condensing lens 2206*c*. Similarly, after the luminous flux Lm is deflected by the polygon mirror 2104A2 and passes through the first scanning lens 2105*d*, part of the luminous flux Lm before writing enters the optical sensor 2205*d* via the optical detection mirrors 2207*d*1 and 2207*d*2, and the condensing lens 2206*d*. The optical sensors 2205*c* and 2205*d* output signals corresponding to the amount of light received. The scanning control device detects when to start writing on the photoconductive drums 2030Y and 2030M according to the signals (synchronization detection signals) outputted by the optical sensors 2205*c* and 2205*d*, respectively.

Referring now to FIGS. 13A, 13B, 13C, and 14, a detailed description is given of the optical scanning device 2010T for the auxiliary color.

Figure 13A:
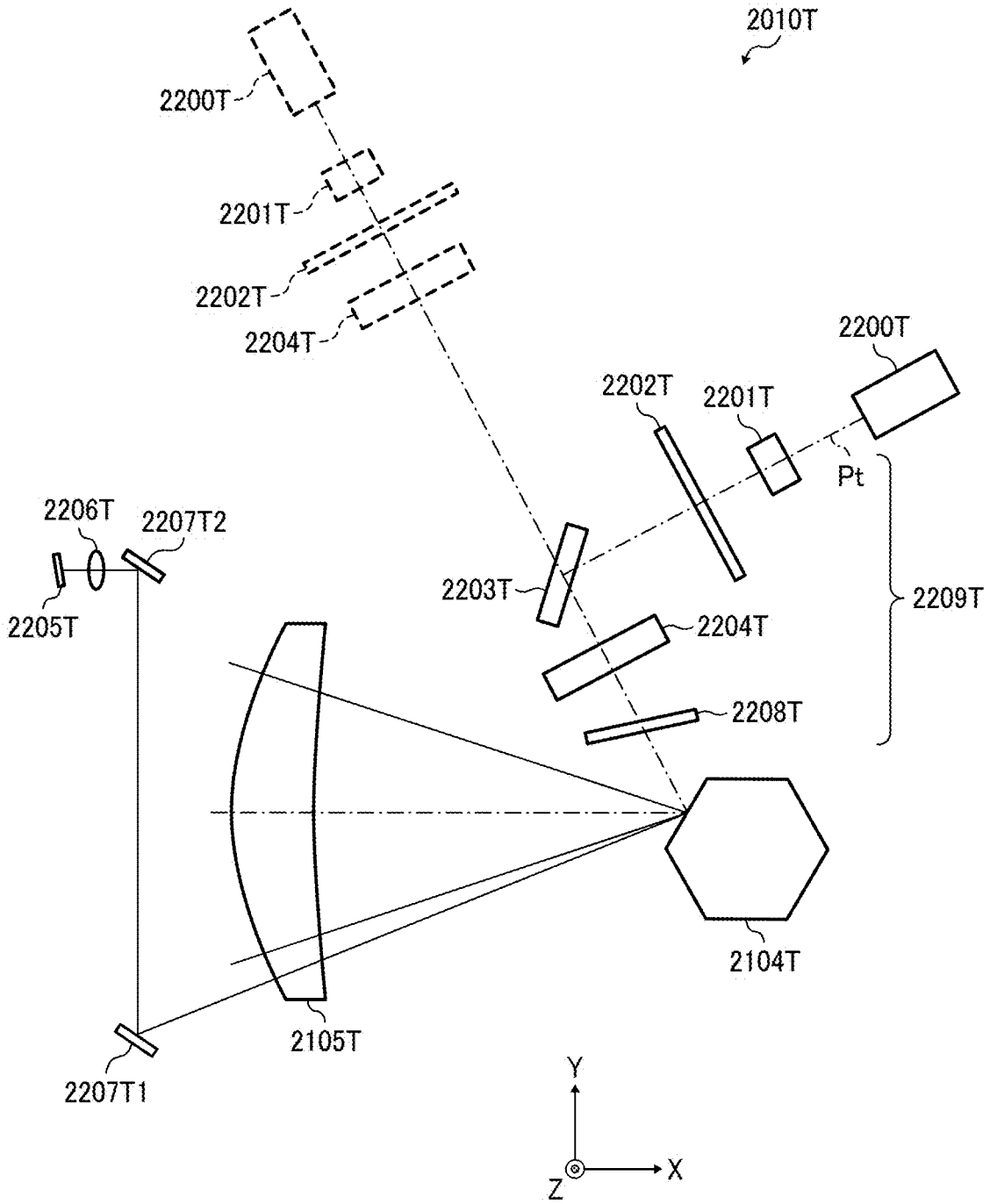
FIG. 13A is a schematic view of a third optical scanning device according to a first embodiment incorporated in the image forming apparatus illustrated in FIG. 1.
Figure 13B:
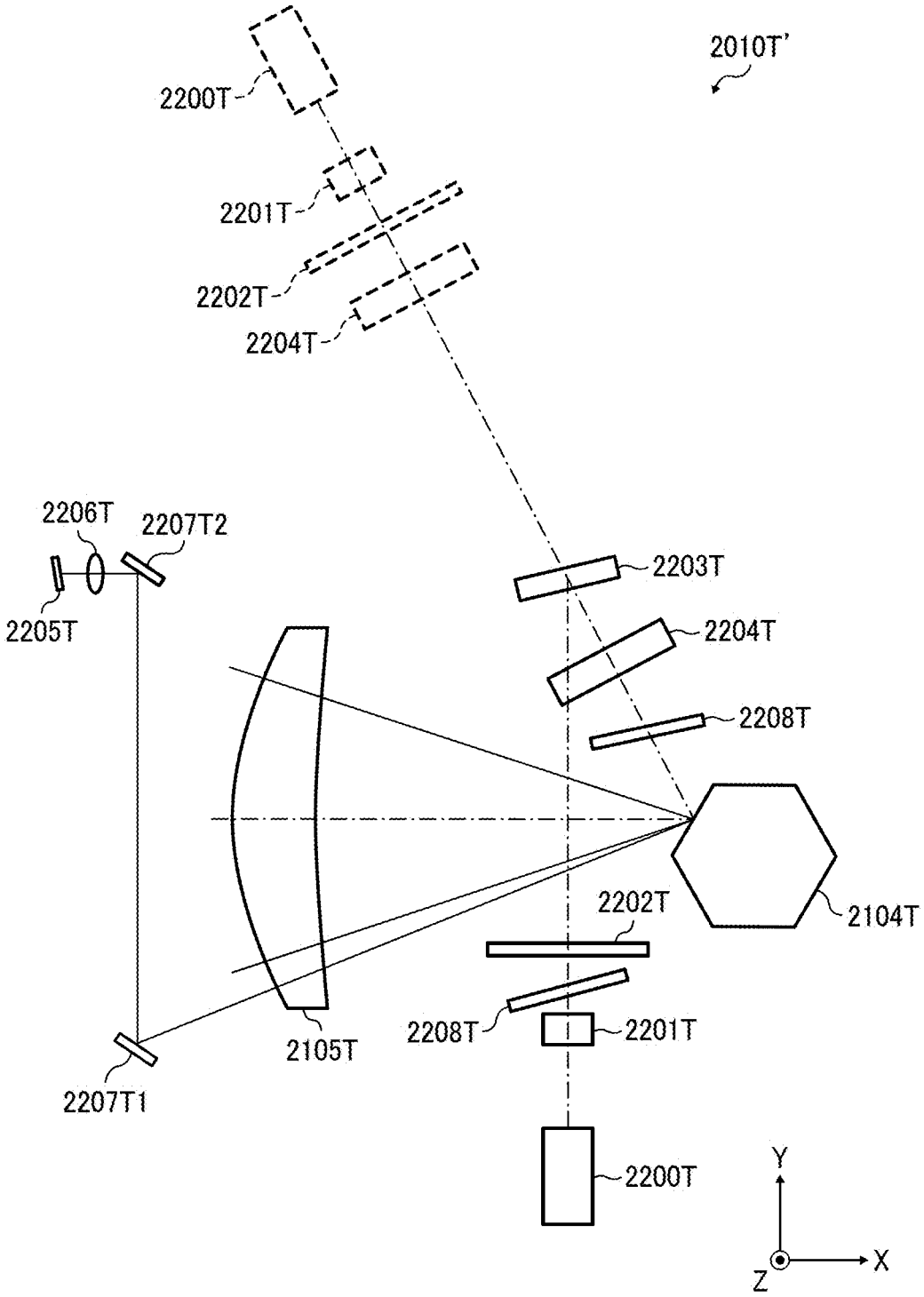
FIG. 13B is a schematic view of a third optical scanning device according to a second embodiment.
Figure 13C:
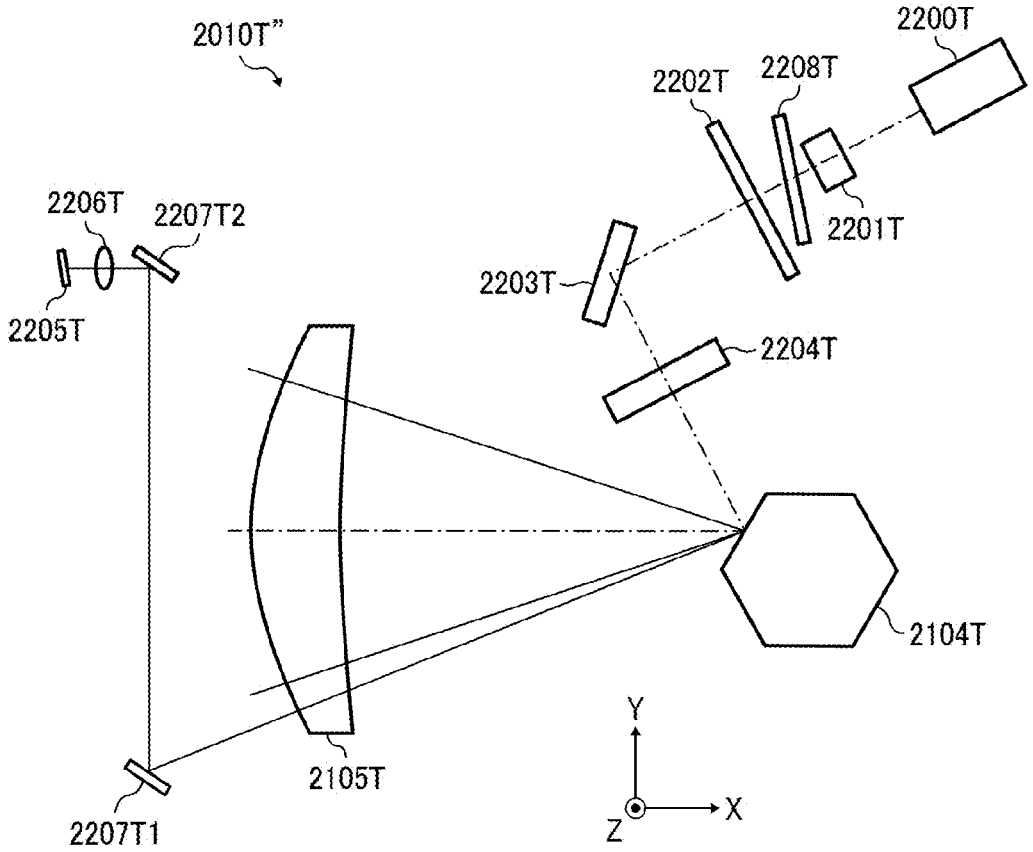
FIG. 13C is a schematic view of a third optical scanning device according to a third embodiment.

FIG. 13A is a schematic view of the optical scanning device 2010T according to a first embodiment incorporated in the image forming apparatus illustrated in FIG. 1. FIG. 13B is a schematic view of an optical scanning device 2010T' according to a second embodiment. FIG. 13C is a schematic view of an optical scanning device 2010T" according to a third embodiment.

As illustrated in FIG. 13A, the optical scanning device 2010T includes, e.g., a light source 2200T, a coupling lens 2201T, an aperture plate 2202T, a reflecting mirror 2203T, a line-image forming lens 2204T, an ND filter 2208T, and a polygon mirror 2104T. The light source 2200T has the same configuration as that illustrated in FIG. 7.

The coupling lens 2201T is disposed on an optical path Pt of the luminous flux Lt emitted by the light source 2200T to turn the luminous flux Lt into substantially parallel luminous flux Lt.

The aperture plate 2202T has an opening to limit the amount of luminous flux Lt passing through the coupling lens 2201T. The aperture plate 2202T has a rectangular shape with a width of about 5.5 mm in the direction S1 and a width of about 1.18 mm in the direction S2. The aperture plate 2202T is disposed such that the center of the opening is located in a focal position of the coupling lens 2201T or the vicinity thereof.

The line-image forming lens 2204T images the luminous flux Lt passing through the opening of the aperture plate 2202T on a reflective surface of the polygon mirror 2104T or the vicinity thereof, in the direction Z. The line-image forming lens 2204T is an anamorphic lens having a first face on an incident side and a second face on an emitting side. The first face has a refractive power in the direction S2. The second face has a refractive power in the direction S1.

An optical system 2209T includes, e.g., the coupling lens 2201T, the aperture plate 2202T, and the line-image forming lens 2204T described above.

According to the first embodiment, the ND filter 2208T is disposed between the line-image forming lens 2204T and the polygon mirror 2104T to adjust light utilization efficiency. With the ND filter 2208T, the optical scanning device 2010T has an optical energy forming one dot substantially equal to that of the optical scanning devices 2010A.

Alternatively, the ND filter 2208T may be disposed at another position. For example, FIG. 13C illustrates an ND filter 2208T disposed between the coupling lens 2201T and the aperture plate 2202T in the optical scanning device 2010T" according to the third embodiment.

Alternatively, a plurality of ND filters 2208T may be disposed. For example, FIG. 13B illustrates an ND filter 2208T disposed between the line-image forming lens 2204T and the polygon mirror 2104T, and another ND filter 2208T disposed between the coupling lens 2201T and the aperture plate 2202T in the optical scanning device 2010T' according to the second embodiment.

Preferably, the ND filter 2208T is oblique to the luminous flux Lt to prevent the luminous flux Lt from returning to the light source 2200T and to stabilize the light source 2200T.

According to the embodiments of this disclosure, the ND filter 2208T is disposed on the optical path Pt from the light source 2200T to the polygon mirror 2104T as in the optical scanning devices 2010A. To obtain identical light utilization efficiency between the optical paths Pc, Pk, Py, and Pm and the optical path Pt, the ND filter is disposed in at least one of the optical scanning devices 2010A and 2010T.

The reflecting mirror 2203T is disposed next to the aperture plate 2202T, between the aperture plate 2202T and the line-image forming lens 2204T, to turn the luminous flux Lt from the light source 2200T at about 90 degrees toward the line-image forming lens 2204T. If the reflecting mirror 2203T is omitted, the light source 2200T might be disposed away from the polygon mirror 2104T in a direction perpendicular to direction Z, as illustrated by broken lines in FIG. 13A, which hampers downsizing of the optical scanning device 2010T.

According to the embodiments of this disclosure, the optical path Pt from the light source 2200T to the polygon mirror 2104T is as long as the optical paths Pc and Pk from the respective light sources 2200*a* and 2200*b* to the polygon mirror 2104A1, and the optical paths Py and Pm from the respective light sources 2200*c* and 2200*d* to the polygon mirror 2104A2. With the reflecting mirror 2203T, the optical scanning device 2010T has a shorter distance between the light source 2200T and the polygon mirror 2104T than the optical scanning devices 2010A1 and 2010A2, in the directions perpendicular to the direction Z (i.e., direction X and direction Y).

Alternatively, the reflecting mirror 2203T may be disposed at another position to downsize the optical scanning device 2010T. For example, FIG. 13B illustrates the reflecting mirror 2203T disposed opposite the light source 2200T across a scanning optical system 2109T in the optical scanning device 2010T' according to the second embodiment.

As described above, one reflecting mirror 2203T is provided in the optical scanning devices 2010T, 2010T' and 2010T" illustrated in FIGS. 13A, 13B, and 13C. Alternatively, a plurality of reflecting mirrors 2203T may be provided therein.

Some typical image forming apparatus have an ND filter (e.g., ND filter 2203*e* illustrated in FIG. 22 of JP-2011-253132-A) in an optical scanning device for an auxiliary color. However, such typical image forming apparatuses having ND filters do not incorporate reflecting mirrors between a polygon mirror and a photoconductive drum to downsize the optical scanning device for the auxiliary color. A reflecting mirror (e.g., reflecting mirror 2203T) peculiar to the optical scanning device (e.g., optical scanning device 2010T) may cause a noticeable misalignment or shifting of the auxiliary color from the correct position because changes to the arrangement of optical elements caused by incorporating the reflecting mirror also changes a layout of light beams. Consequently, initial characteristics and temperature characteristics of a scanning line of the auxiliary color may differ from those of the four fundamental colors over time, and particularly by variation of characteristics due to temperature changes.

According to the embodiments of this disclosure, the reflecting mirror 2203T is provided to downsize the optical scanning device 2010T for the auxiliary color, while the ND filter 2208T is provided to adjust optical transmittance to compensate for variation of, e.g., initial characteristics and temperature characteristics caused by the reflecting mirror 2203T. As described above, the ND filter 2208T is provided to adjust light utilization efficiency. Alternatively, the light utilization efficiency may be adjusted by changing reflectance or transmittance of the optical elements disposed on the optical path Pt from the light source 2200T to the polygon mirror 2104T. For example, the light utilization efficiency may be adjusted by changing conditions for coating a surface of the coupling lens 2201T or the line-image forming lens 2204T.

The polygon mirror 2104T is, e.g., a hexagon having six deflection surfaces and rotatable about its axis parallel to the direction Z. A circle inscribed within the hexagon has a radius of, e.g., about 25 mm. The luminous flux Lt from the line-image forming lens 2204T is deflected by the polygon mirror 2104T toward the −X side of the polygon mirror 2104T.

As illustrated in FIGS. 13A, 13B, 13C and 14, the optical scanning device 2010T includes, on the −X side of the polygon mirror 2104T, e.g., a first scanning lens 2105T disposed near the polygon mirror 2104T, a second scanning lens 2107T disposed near an image plane (see FIG. 14), two reflecting mirrors 2106T and 2108T (see FIG. 14), an optical sensor 2205T, a condensing lens 2206T, two optical detection mirrors 2207T1 and 2207T2, and a scanning control device.

Figure 14:
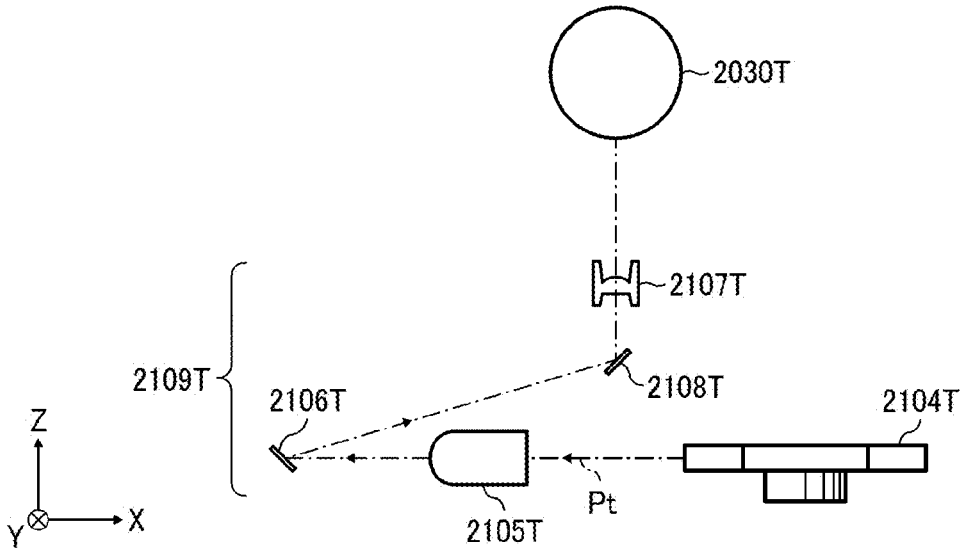
FIG. 14 is a partially enlarged view of the third optical scanning device illustrated in FIG. 13A.

Referring to FIG. 14, a description is given of a scanning optical system 2109T.

FIG. 14 is a partially enlarged view of the optical scanning device 2010T, illustrating the scanning optical system 2109T.

The scanning optical system 2109T includes, e.g., the first scanning lens 2105T, the reflecting mirrors 2106T and 2108T, and the second scanning lens 2107T, disposed on the optical path Pt between the polygon mirror 2104T and the photoconductive drum 2030T. The scanning optical system 2109T has the same configuration as the scanning optical systems 2109C, 2109K, 2109Y and 2109M.

The first scanning lens 2105T is disposed on the optical path Pt of the luminous flux Lt deflected by the polygon mirror 2104T. The reflecting mirror 2106T is disposed to turn the optical path Pt of the luminous flux Lt passing through the first scanning lens 2105T toward the reflecting mirror 2108T. The reflecting mirror 2108T is disposed to turn the optical path Pt turned by the reflecting mirror 2106T toward the photoconductive drum 2030T. The second scanning lens 2107T is disposed on the optical path Pt between the reflecting mirror 2108T and the photoconductive drum 2030T. The second scanning lens 2107T has a positive refractive index in the direction S2.

Accordingly, the surface of the photoconductive drum 2030T is irradiated with the luminous flux Lt passing through the line-image forming lens 2204T and deflected by the polygon mirror 2104T, via the first scanning lens 2105T, the reflecting mirrors 2106T and 2108T, and the second scanning lens 2107T in this order. Thus, an optical spot is formed on the surface of the photoconductive drum 2030T.

Rotation of the polygon mirror 2104T moves the optical spot thus formed in the longitudinal direction of the photoconductive drum 2030T. Thus, the surface of the photoconductive drum 2030T is irradiated. The optical spot moves on the surface of the photoconductive drum 2030T in a main scanning direction of the photoconductive drum 2030T. The photoconductive drum 2030T rotates in a sub-scanning direction of the photoconductive drum 2030T.

Referring back to FIG. 13A, after the luminous flux Lt is deflected by the polygon mirror 2104T and passes through the first scanning lens 2105T, part of the luminous flux Lt before writing enters the optical sensor 2205T via the optical detection mirrors 2207T1 and 2207T2, and the condensing lens 2206T. The optical sensor 2205T outputs a signal corresponding to the amount of light received. The scanning control device detects when to start writing on the photoconductive drum 2030T according to the signal (synchronization detection signal) outputted by the optical sensor 2205T.

Figure 15:
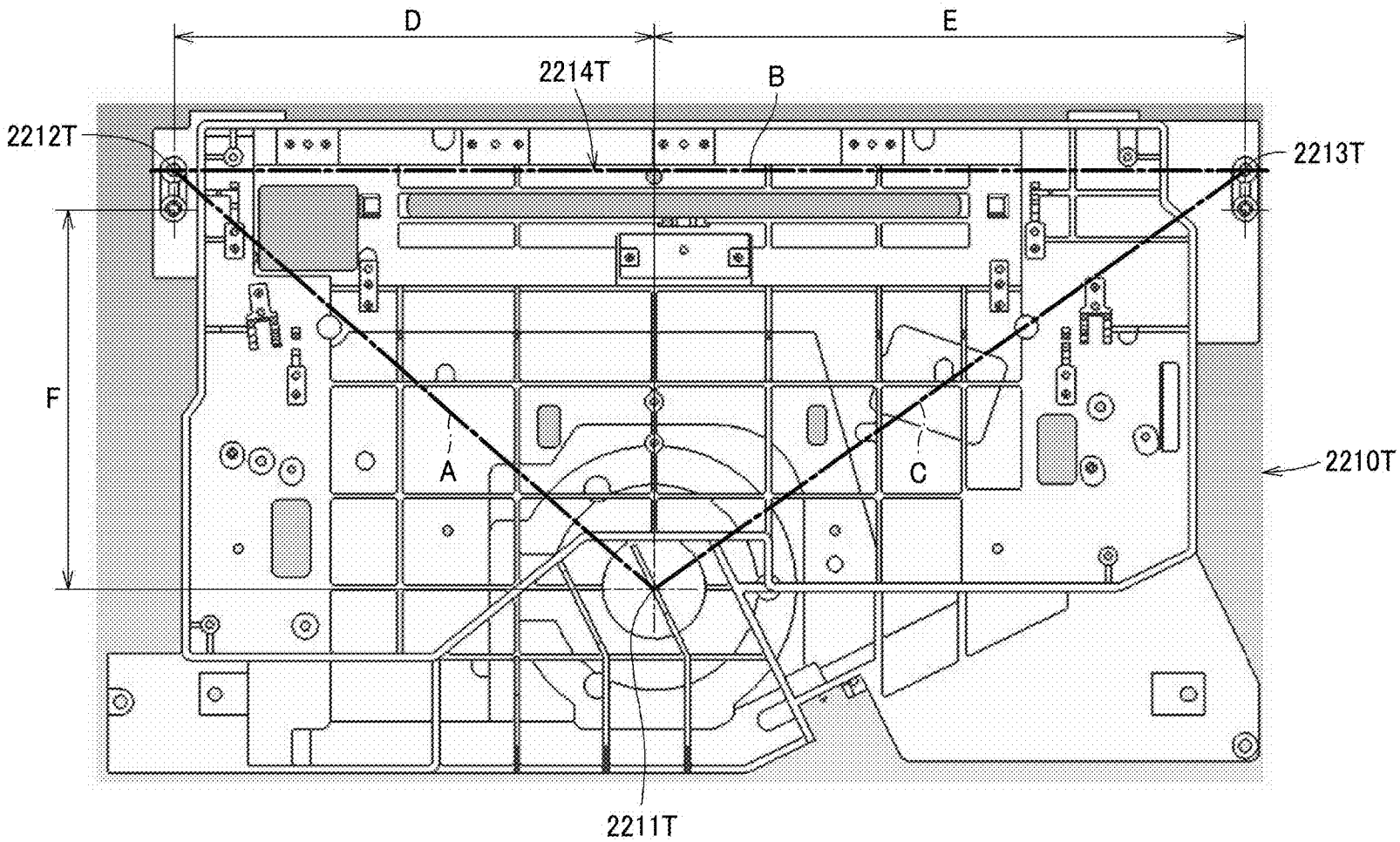
FIG. 15 is a schematic view of an optical housing for the third optical scanning device illustrated in FIG. 13A.

The scanning optical system 2109T is installed at predetermined positions in an optical housing 2210T, serving as a third optical housing, illustrated in FIG. 15. The scanning optical systems 2109K and 2109C are installed at predetermined positions in the optical housing 2210CK illustrated in FIG. 16. The scanning optical systems 2109M and 2109Y are installed at predetermined positions in the optical housing 2210YM having the same shape and configuration as the optical housing 2210CK illustrated in FIG. 16.

The optical housings 2210CK, 2210YM and 2210T are removably mounted on a main body frame 2100 of the image forming apparatus 2000 (hereinafter simply referred to as main body frame 2100) illustrated in FIG. 1. The main body frame 2100 has holes for main location pins 2212CK, 2212YM, and 2212T (hereinafter collectively referred to as main location pins 2212) and holes for sub-location pins 2213CK, 2213YM, and 2213T (hereinafter collectively referred to as sub-location pins 2213) to locate the optical housings 2210CK, 2210YM and 2210T, respectively, in the main body frame 2100.

Figure 16:
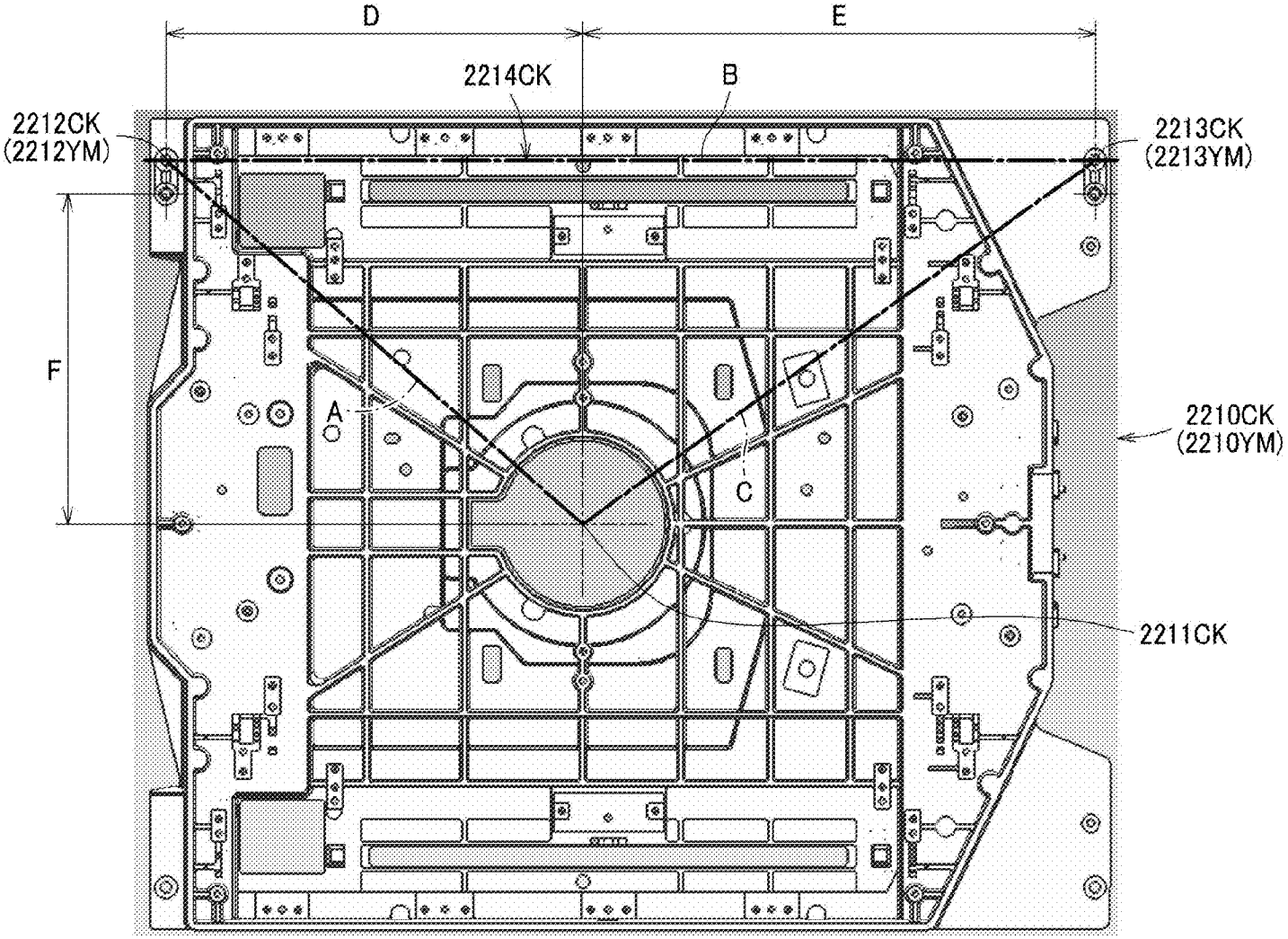
FIG. 16 is a schematic view of an optical housing for the first optical scanning device illustrated in FIG. 3.

Referring now to FIGS. 15 and 16, detailed descriptions are given of the optical housings 2210CK and 2210T. A detailed description of the optical housing 2210YM is herein omitted unless otherwise required because, as described above, the optical housing 2210YM has the same shape and configuration as the optical housing 2210CK.

Main location pins 2212T and 2212CK and sub-location pins 2213T and 2213CK are configured to be engaged with the holes formed in the main body frame 2100. In some embodiments, as illustrated in FIGS. 15 and 16, each of the holes for the main location pins 2212T and 2212CK may be elongated. In other embodiments, each of the holes for the main location pins 2212T and 2212CK may be a circular, positioning hole serving as a main reference of the main body frame 2100. Each of the holes for the sub-location pins 2213T and 2213CK is an elongate hole serving as a sub-reference of the main body frame 2100. The sub-location pins 2213T and 2213CK are movable in the elongate holes upon, e.g., thermal expansion.

Referring to FIG. 15, a rotational center 2211T of the polygon mirror 2104T is positioned relative to the main location pin 2212T and to the sub-location pin 2213T with a predetermined relative positional relationship thereamong in the optical housing 2210T. Thus, the main location pin 2212T, the sub-location pin 2213T and the rotational center 2211T form a predetermined triangle 2214T having a first side A, a second side B, and a third side C.

Referring to FIG. 16, a rotational center 2211CK of the polygon mirror 2104A1 is positioned relative to the main location pin 2212CK and to the sub-location pin 2213CK with a predetermined relative positional relationship thereamong in the optical housing 2210CK.

Thus, the main location pin 2212CK, the sub-location pin 2213CK and the rotational center 2211CK form a predetermined triangle 2214CK having a first side A, a second side B, and a third side C. The triangles 2214T and 2214CK have the same size and shape. Horizontal and vertical lengths D, E, and F from the rotational center 2211T to the main location pin 2212T and to the sub-location pin 2213T illustrated in FIG. 15 are the same as horizontal and vertical lengths D, E, and F from the rotational center 2211CK to the main location pin 2212CK and to the sub-location pin 2213CK illustrated in FIG. 16.

The polygon mirrors 2104A1, 2104A2 and 2104T incorporated in the optical housings 2210CK, 2210YM, and 2210T (hereinafter collectively referred to as optical housings 2210), respectively, generate heat some time after starting to rotate, thereby thermally expanding the optical housings 2210. As a result, a synchronous detection plate configured to control when to start writing an image at the correct position is shifted. If the synchronous detection plate is shifted, a light-beam scanning position for each color may be misaligned or shifted from the correct position. As a result, a full-color toner image formed on the transfer belt 2040 may have a color registration error, thereby degrading image quality.

According to the embodiments of this disclosure, the optical housings 2210 have the same positioning references with respect to the main body frame 2100. Accordingly, the optical housings 2210 may be similarly deformed upon, e.g., thermal expansion, thereby preventing the color registration error, which might be caused by deformation differences thereamong.

Particularly, as illustrated in FIG. 1, the optical scanning device 2010A1 and the optical scanning device 2010T are disposed away from each other in the direction X. More particularly, the optical elements for black located on a right side in the optical housing 2210CK are disposed away from the optical elements for the auxiliary color located in the optical housing 2210T in the direction X. Hence, the optical scanning device 2010A1 and the optical scanning device 2010T thus disposed away from each other may have a relatively large difference in the environmental temperature conditions. To prevent the color registration error caused by the deformation differences among the three optical housings 2210, as described above, the optical housings 2210 have the same positioning references with respect to the main body frame 2100.

In addition, the main location pins 2212 are located in the same positions in the optical housings 2210. The sub-location pins 2213 are also located in the same positions in the optical housings 2210. Accordingly, the same jigs can be used in the optical scanning devices 2010A and 2010T, thereby reducing production costs.

As described above, according to the embodiments of this disclosure, the optical scanning device for the auxiliary color (e.g., optical scanning device 2010T) can be downsized by incorporating a reflecting mirror (e.g., reflecting mirror 2203T) to turn an optical path (e.g., optical path Pt) from a light source (e.g., light source 2200T) to a polygon mirror (e.g., polygon mirror 2104T) so that the distance between the light source and the polygon mirror is shorter than the distances between the light sources (e.g., light source 2200*a*) and the polygon mirrors (e.g., polygon mirror 2104A1) for the four fundamental colors. The light utilization efficiency with respect to the auxiliary color equal to the light utilization efficiency with respect to the black color prevents the reflecting mirror from causing misalignment or shifting of the auxiliary color. Thus, the frequency of color shift correction can be reduced, and therefore, the standby time can be reduced.

This disclosure has been described above with reference to specific exemplary embodiments. It is to be noted that this disclosure is not limited to the details of the embodiments described above, but various modifications and enhancements are possible without departing from the scope of the invention.

For example, toner images of black, cyan, magenta, yellow and an auxiliary color can be superimposed in any order. For example, toner images of cyan, yellow, magenta, black and an auxiliary color can be superimposed in this order.

The auxiliary color is not limited to one color. Alternatively, toner of a plurality of auxiliary colors, e.g., two light colors of light cyan and light yellow, may be used. In such a case, a third polygon mirror may be rotatably mounted on a third optical housing to deflect luminous flux from two light sources for the two light colors in an optically symmetrical manner.

It is therefore to be understood that this disclosure may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus for forming a multicolor image with toner of four fundamental colors of yellow, magenta, cyan, and black, and toner of at least one auxiliary color different from the four fundamental colors, the image forming apparatus comprising:

a main body frame;

a plurality of image carriers for the four fundamental colors;

an image carrier for the at least one auxiliary color;

a first optical scanning device for the black color and another color of the four fundamental colors, to irradiate each of the plurality of image carriers for the black color and the another color of the four fundamental colors to form a latent image thereon;

a second optical scanning device for other two of the four fundamental colors, to irradiate each of the plurality of image carriers for the other two of the four fundamental colors to form a latent image thereon; and a third optical scanning device for the at least one auxiliary color, to irradiate the image carrier for the at least one auxiliary color to form a latent image thereon, the first optical scanning device including:

two light sources for the black color and the another color of the four fundamental colors, respectively, to output luminous flux;

a first deflector to deflect the luminous flux in an optically symmetrical manner; and a first optical housing removably mounted on the main body frame, the first deflector rotatably mounted on the first optical housing, the second optical scanning device including:

two light sources for the other two of the four fundamental colors, respectively, to output luminous flux;

a second deflector to deflect the luminous flux in an optically symmetrical manner; and a second optical housing removably mounted on the main body frame, the second deflector rotatably mounted on the second optical housing, the third optical scanning device including:

a light source for the at least one auxiliary color to output luminous flux;

a third deflector to deflect the luminous flux; and a third optical housing removably mounted on the main body frame, the third deflector rotatably mounted on the third optical housing, the third optical scanning device further including one or more reflecting mirrors disposed on an optical path from the light source for the at least one auxiliary color to the third deflector, with a distance between the light source for the at least one auxiliary color and the third deflector shorter than a distance between each of the light sources for the four fundamental colors and the first deflector and the second deflector, to turn the optical path from the light source for the at least one auxiliary color to the third deflector while maintaining an optical path length thereof equal to each of optical path lengths from the light sources for the four fundamental colors to the first deflector and the second deflector, the optical path from the light source for the at least one auxiliary color to the third deflector having a light utilization efficiency equal to a light utilization efficiency of the optical path from the light source for the black color to the first deflector, wherein the main body frame has pins formed therein, each of the first through third optical housings have at least two holes therein to correspond with the pins, and at least one of the holes in each of the first through third optical housings is elongated such that, when the first through third optical housings are mounted in the main body frame, horizontal and vertical distances from respective ones of the elongated holes to a rotational center of respective ones of the first through third deflectors vary identically in each of the first through third optical housings in response to thermal expansion generated by the respective ones of the first through third deflectors.

2. The image forming apparatus according to claim 1, wherein reflectance or transmittance of at least one of an optical element disposed on the optical path from the light source for the black color to the first deflector and an optical element disposed on the optical path from the light source for the at least one auxiliary color to the third deflector is adjusted to equalize the light utilization efficiency between the optical path from the light source for the black color to the first deflector and the optical path from the light source for the at least one auxiliary color to the third deflector.

3. The image forming apparatus according to claim 2, wherein the at least one of the optical element disposed on the optical path from the light source for the black color to the first deflector and the optical element disposed on the optical path from the light source for the at least one auxiliary color to the third deflector is a neutral density filter.

* * * * *